US005377418A

United States Patent [19]

Anderson

[11] Patent Number: 5,377,418

[45] Date of Patent: Jan. 3, 1995

[54] T-SQUARE, AND METHODS OF CONSTRUCTION AND UTILIZING SAME

[76] Inventor: Dean H. Anderson, P.O. Box 341, Garrison, N.Y. 10524

[21] Appl. No.: 110,316

[22] Filed: Aug. 23, 1993

[51] Int. Cl.[6] ..... B43L 7/14

[52] U.S. Cl. ..... 33/478; 33/464; 33/469

[58] Field of Search ..... 33/419, 427, 464, 469, 33/470, 473, 474, 478, 479

[56] References Cited

U.S. PATENT DOCUMENTS

| | | | |
|---|---|---|---|
| 761,707 | 6/1904 | Peyman | 33/464 |
| 867,812 | 10/1907 | Edwards | 33/478 |
| 1,402,774 | 1/1922 | La Dow | 33/485 |
| 1,984,951 | 12/1934 | Stowell | 33/464 |
| 2,104,515 | 1/1938 | Golden | 33/479 |
| 2,404,911 | 7/1946 | King | 33/464 |
| 4,245,394 | 1/1981 | Peterson | 33/430 |
| 4,301,600 | 11/1981 | Charnley | 33/464 |
| 4,599,806 | 7/1986 | Wright | 33/469 |
| 4,736,524 | 4/1988 | King | 33/469 |

FOREIGN PATENT DOCUMENTS

| | | | |
|---|---|---|---|
| 2-147301 | 6/1990 | Japan | 33/483 |

*Primary Examiner*—William A. Cuchlinski, Jr.
*Assistant Examiner*—G. Bradley Bennett
*Attorney, Agent, or Firm*—Irving M. Weiner; Joseph P. Carrier; Pamela S. Burt

[57] ABSTRACT

A T-square device with a mechanism for efficient adjustment thereof. The device includes a scale, base, and trigger mechanism. The trigger mechanism is spring-loaded for automatic locking of the base to the scale. Applying a force on the trigger counteracts the spring-induced forces and thereby releases the lock on the base to the scale, thus allowing the base to be slidable along the scale. The base and trigger mechanism is sized proportionally to fit the human hand.

14 Claims, 2 Drawing Sheets

T-SQUARE, AND METHODS OF CONSTRUCTION AND UTILIZING SAME

BACKGROUND OF THE INVENTION

1. Field of Invention

This invention relates to a measurement and cutting device, and more particularly to a combination gauge which includes a T-square head having a quick-release trigger mechanism for quick and simple adjustment of the T-square head along a ruled scale, and a protractor head with a quick-release cam mechanism for quick and simple adjustment of the protractor head along the ruled scale.

2. Description of the Relevant Art

There are known T-squares, calipers, and gauges that include T-square or protractor heads having various clamping mechanisms for attachment to a scale. For example, U.S. Pat. No. 253,945 discloses a clamp for T-squares that uses a pivoting lever and socket mechanism disposed in a T-square head to bear pressure against a ruled scale so as to secure the head thereto. This clamp, however, cannot be easily and quickly operated with one hand.

Further, U.S. Pat. No. 968,679 discloses a measurement tool which includes a tail-nut assembly to secure a stock member into the desired angular position relative a scale. This invention, however, fails to provide a tool that can be efficiently adjusted, or one that can be adjusted with one hand.

In addition, U.S. Pat. No. 1,379,253 discloses a gage which includes a cam-locking mechanism for locking an attachment member to a scale. Similarly to the other known devices, this invention fails to disclose a tool that can be quickly and easily adjusted.

Still further, U.S. Pat. No. 4,446,627 discloses an angle ruler or T-square having a pair of blades which are pivotally connected together such that an angle between the blades can be selectively adjusted by a spring-operated peg mechanism. This invention, however, cannot be adjusted quickly or with one hand.

SUMMARY OF THE INVENTION

The present invention overcomes the above-discussed limitations and shortcomings of known measurement and cutting guides and thereby satisfies a significant need for such a device with quick, simple, and secure adjustment of the connection and alignment between members of the device.

According to the preferred embodiments of the present invention, there is provided a measurement and cutting guide which includes a ruled scale and a T-square head operatively engageable therewith. The T-square head includes a quick-release trigger means for quick, simple, and secure adjustment of the head along the scale. The trigger means includes spring biasing means for automatic locking of the head along the scale upon deactivation thereof. Additionally, the head and trigger means are sized and shaped to accommodate control or operation thereof with only one hand.

Additionally, there is provided a protractor member operatively slidably engageable with the scale and fully adjustable therewith for providing an edge which forms an angle relative to the scale. The protractor includes a quick-release cam mechanism for locking the protractor against sliding movement along the scale. Setting the protractor at the desired angle relative to the scale is accomplished by a threaded nut with an enlarged head for easy use therewith.

In use, the T-square head engages with the scale by inserting the scale within a slot shaped similarly to the edge of the scale and located along one side of the head. The head can be easily slid along the scale upon activating the head's trigger means. Such activation is accomplished by gripping the trigger means with one hand and pulling or squeezing the trigger toward a handle of the head. The head is locked firmly in place at the desired position along the scale upon deactivation of the trigger mechanism through engagement with a spring biased pressure pall formed integrally with the trigger means. Further, the protractor head engages with the scale by inserting the scale within a slot also shaped similarly to the edge of the scale. The protractor head can be easily slid or locked into secure engagement along the scale upon activating the head's cam simple locking means.

It is an object of the invention to provide a measurement and cutting device which can be quickly, easily, and securely adjusted along a ruled scale.

Another object of the invention is to provide such a measurement and cutting guide that is adjustable with only one hand.

Still another object of the invention is to provide a measurement and cutting device that is of a sturdy construction and which achieves very reliable securement of the several parts thereof so as to be used with a wide range of marking and cutting devices.

Other objects, advantages and salient features of the present invention will become apparent from the following detailed description, which, when taken in conjunction with the annexed drawings, discloses preferred embodiments of the present invention.

DETAILED DESCRIPTION OF THE PREFERRED EMBODIMENTS

Figure 1:
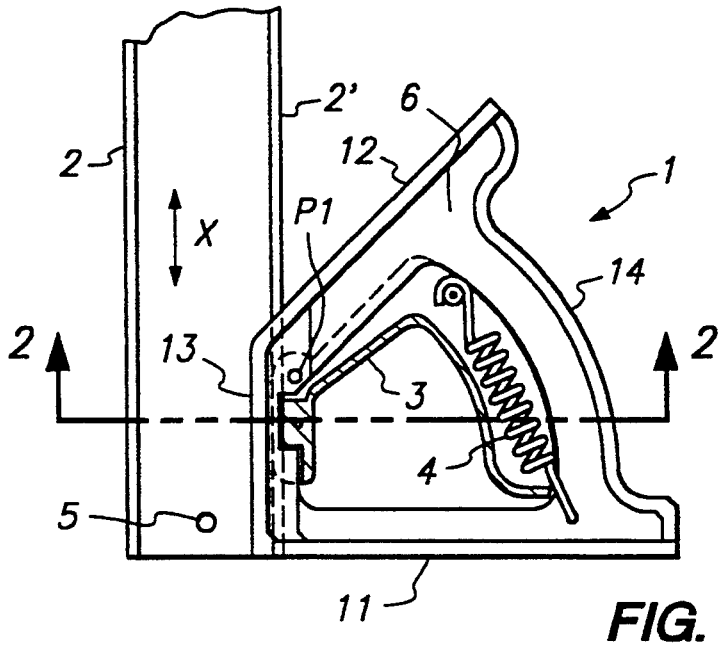
FIG. 1 is a side view of the first preferred embodiment of the present invention showing the T-square head and scale under engagement.
Figure 2:
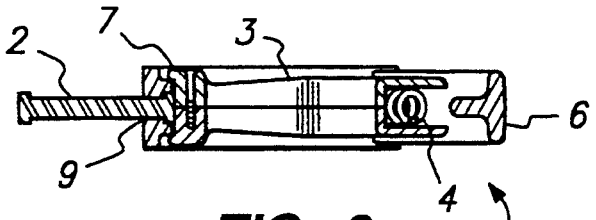
FIG. 2 is a bottom sectional view of a first preferred embodiment taken along the 2—2 line in FIG. 1 showing the head and scale under engagement.

Referring to FIGS. 1 and 2, there is shown a measurement and cutting guide according to a first preferred embodiment of the invention, including scale 2 and head 1. Scale 2 provides scale graduations along its sides, for example 1/16". The length of scale 2 is sized so as to be useful in a variety of situations, for example 24", 36", or 60". In order to provide secure engagement with head 1, scale 2 preferably is manufactured with enlarged edges which slidingly engage with corresponding recesses formed in the T-square and protractor heads. For example the scale could be formed with I-beam cross section, as shown in FIG. 2 so that an enlarged T-shaped edge of the scale would slidingly fit in a corresponding T-shaped recess formed in the head. Scale 2 and the T-square and protractor heads are preferably created from a sturdy yet relatively lightweight material such as aircraft aluminum so as to be useful with a variety of tools, such as power saws. A mounting hole 5 is preferably located at one end of scale 2 for attachment to standard equipment.

Head 1 operatively connects with scale 2 so as to form standard-sized angles therewith. As shown in FIG. 1, head 1 preferably comprises base 6, trigger 3, and spring 4. Base 6 is preferably shaped with side 11 perpendicular to, and side 12 forming a 135 degree angle with side 13 which runs parallel to scale 2 when engaged therewith. Thus when head 1 engages with scale 2, a right angle is formed between scale 2 and side 11 of head 1, and a 45 degree angle is simultaneously formed between scale 2 and the side 12 of head 1. Head 1 engages with scale 2 by inserting an enlarged edge 2' of scale 2 through the correspondingly T-shaped slot or recess 9 which is located along the side 13 of base 6, as shown in FIG. 2. By inserting an edge of I-shaped scale 2 within head 1, movement of head 1 relative to scale 2 is substantially limited to sliding movement. Side 14 preferably is substantially rounded so as to form a handle, thereby providing a comfortably-fitting surface when gripped by a hand, for activating the trigger assembly.

The trigger assembly of the first embodiment of the present invention includes trigger 3, spring 4, and pressure pad 7. As shown in FIGS. 1 and 2, trigger 3 fits substantially within base 6 and pivotally connects thereto at point P1. Pressure pad 7 is preferably formed integrally with the trigger at one end thereof 3 and is spaced at a small distance X from pivot point P1, and provides outward pressure, relative to the head 1, against the inserted edge of scale 2 when engaged therewith. Spring 4 is anchored at one end to base 6 and at the other end to trigger 3 at an intermediate portion thereof spaced a distance Y from pivot point P1, thus exerting a force on trigger 3 to cause trigger 3 to rotate towards side 11 and about pivot point P1. This rotation of trigger 3 pivotally moves pressure pad 7 a small distance, such as a few degrees of rotation, into T-slot 9 of base 6 so as to apply a significant outward pressure on an inserted edge of scale 2 thereby securely sandwiching the edge between the pad and a surface of the slot 9 to securely lock head 1 in position along scale 2. By having distance Y greater than distance X, a force greater than the spring-induced force is applied by pressure pad 7 to scale 2 so as to firmly lock head 1 into position along scale 2. As shown the trigger 3 and pressure pad 7 are preferably integrally formed as a substantially U-shaped unitary member with the trigger formed at the end of one arm thereof and the pressure pad formed at the end of the other arm thereof.

Applying a relatively small force on trigger 3 towards side 14 counteracts the spring-activated forces of coil spring 4, thereby withdrawing pressure pad 7 from T-slot 9 and releasing head 1 from fixed engagement with scale 2. The small angle necessary to rotate pressure pad 7 so as to withdraw it from T-slot 9 and release pressure upon scale 2 determines minimal distance X. Because of the special relationship between trigger 3, spring 4, pressure pad 7, and pivot point P, a large force sufficient to fix scale 2 is applied through a compounding of forces through ever decreasing distances to gain substantial advantage over the distance as a whole, such that the force induced by spring 4 maintains scale 2 fast, while the force required to release the same is within the limits of the human hand.

Figure 5:
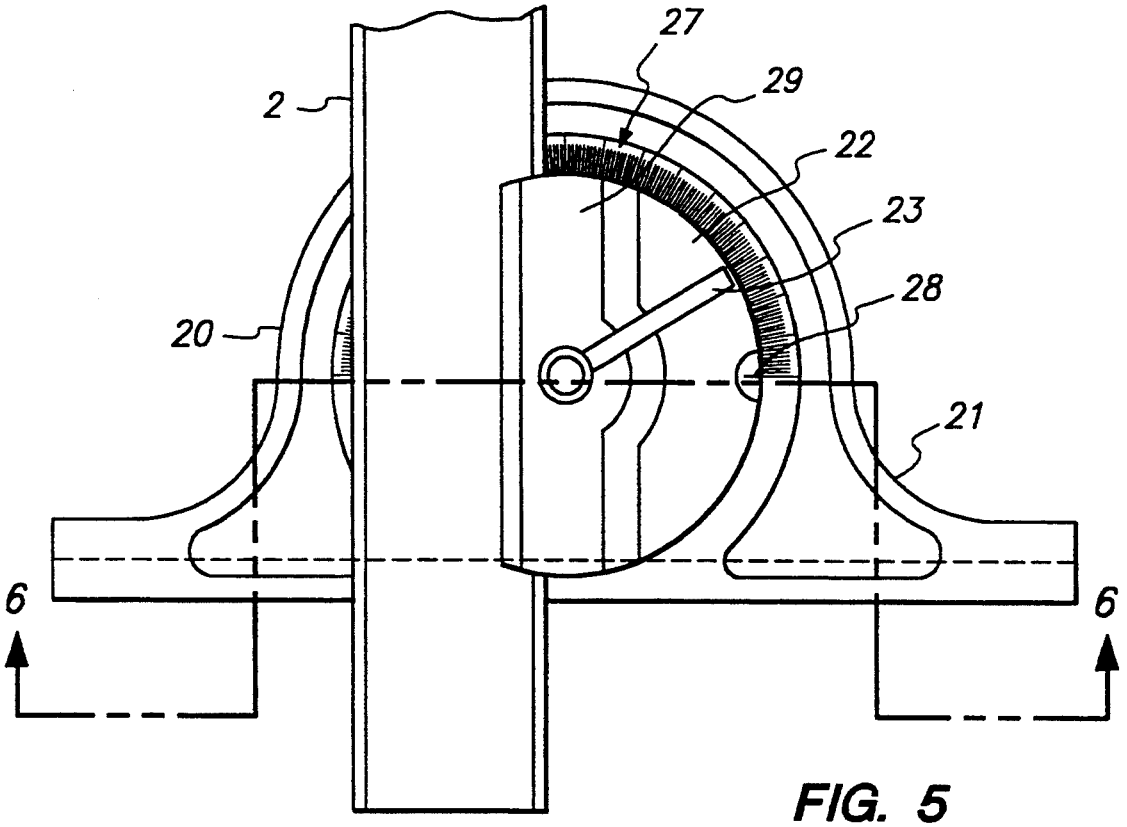
FIG. 5 is a frontal view of the protractor head of the present invention showing engagement with the scale.
Figure 6:
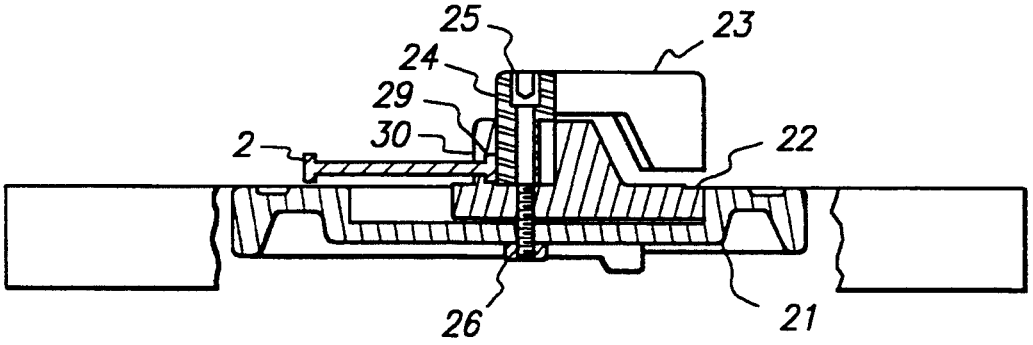
FIG. 6 is a side sectional view of the protractor head taken along the 6—6 line in FIG. 5 showing the protractor head and scale under engagement.

Referring to FIGS. 5 and 6, there is shown protractor head 20 which is included in a first preferred embodiment of the invention and used to form an adjustable angle with scale 2 when engaged therewith. Protractor head 20 includes base 21, rotator insert 22, lever 23, cam 24, bolt 25, and nut 26. Base 21 is preferably but not necessarily bell-shaped, and at least one edge of base 21 is used to form an angle with scale 2. The exposed face of base 21 includes graduations 27 denoting degrees arranged preferably in a circular pattern, within which a recessed area is formed for engagement with rotator insert 22, while the insert 22 preferably has an indicator 28 which indicates the degree at which the protractor is locked in place.

Rotator insert 22, lever 23, and cam 24 are used to simply yet securely fix the position of protractor head 20 along scale 2. Insert 22 includes a projecting portion 29 with a T-shaped slot or recess 30 defined therein for sliding engagement with I-shaped scale 2. The slot 30 is preferably shaped substantially identical to the slot 9 in head 1 so that either the head 1 or the protractor can be slid along either side of scale 2. Cam 24 is attached to lever 23 and insert 22 by bolt 25. By simply rotating lever 23 in one direction, an engagement portion of cam 24 can be moved into slot 30 for thereby exerting an outward force on scale 2 against slot 30 so as to lock protractor head 20 into position along scale 2. Rotating lever 23 in the opposite direction withdraws cam 23 from slot 30 and thereby removes the outward force on scale 2 so protractor head 20 can slide along scale 2 for repositioning therewith. the lever 23 preferably has an enlarged end 31 formed thereon for facilitating gripping. Insert 22 preferably is situated in the recessed area of base 21 for rotation therein, and is secured thereto by bolt 25, which extends through base 21 and engages with nut 26. Base 21 is thus locked into the desired angle relative to insert 22 and scale 2 by tightening nut 26. The outer edge of nut 26 is enlarged and includes serrations for easy and secured adjustment by hand.

In an alternative configuration, a trigger means such as used on head 1 can be used to lock protractor head 20 into position along scale 2.

In use, scale 2 is inserted in T-slot 9 of head 1. By gripping head 1 at side 14 and applying pressure to trigger 3, pressure pad is moved out of slot 9 so that head 1 can be slid along scale 2. Releasing such pressure locks head 1 in the desired position along scale 2 through engagement with pressure pad as discussed above. Similarly, for the purpose of obtaining an edge at any desired angle relative to scale 2, scale 20 is inserted in slot 30 of protractor head 20. By rotating lever 23 in one direction, the cam is moved out of slot 30 and protractor head 20 is slidable along scale 2. Rotating lever 23 in the other direction locks protractor head 20 into position along scale 2 through engagement with the cam 24.

Figure 3:
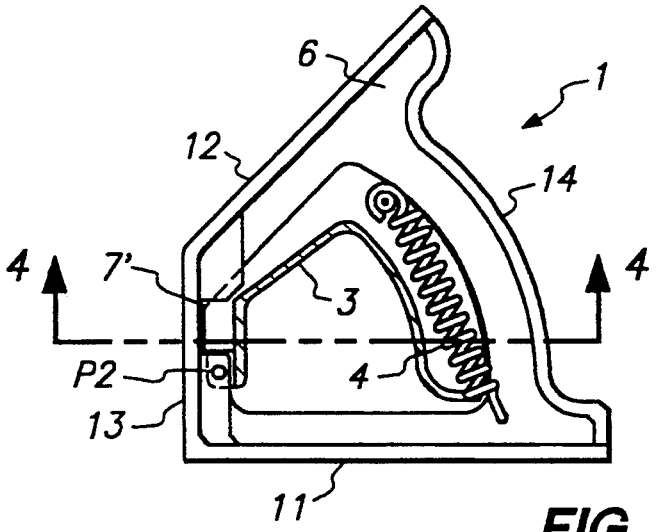
FIG. 3 is a side view of a second preferred embodiment of the present invention showing the T-square head.
Figure 4:
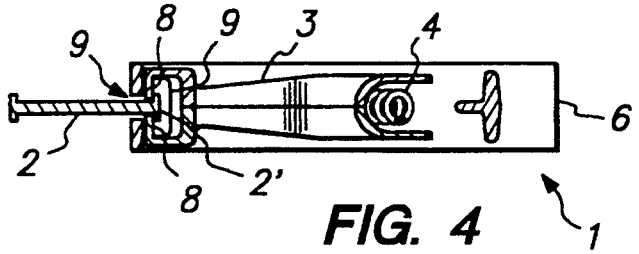
FIG. 4 is a bottom sectional view of the second preferred embodiment taken along the 4—4 line in FIG. 2 showing the head and scale under engagement.

Referring to FIGS. 3 and 4 there is shown a T-square according to a second preferred embodiment of the invention which is substantially similar to the first embodiment except for the location of the pivot P2 relative to the pressure pad 7' and the direction of movement of the pressure pad 7' relative to the slot for securing engagement with the scale 2. As with the first embodiment, the second embodiment includes scale 2 and head 1. Head 1 again includes base 6, trigger 3 and spring 4. Instead of using a pressure pad such as pad 7 of the first embodiment to engage with scale 2, one end of trigger 3 is substantially C-shaped in cross section with of the pressure pads 8 located thereon at a distance X from pivot point P2 and such that the enlarged edge 2' of the scale fits within the C-shaped cross section. The C-shaped end of trigger 3 fits within T-slot 9 as shown in FIG. 4. Spring 4 is attached at one end to base 6 and at the other to trigger 3 at a distance Y from pivot point P2, and forces trigger 3 to rotate about pivot pin P2 towards side 11, thus causing pressure pads 8 to rotate similarly. Such rotation of trigger 3 and pressure pads 8 exerts an inward force, relative to the head 1, on the enlarged edge 2' of scale 2 against T-slot 9, when head 1 is engaged therewith, thus locking head 1 to scale 2. By having distance Y greater than distance X, a force greater than the spring-induced force is applied by pressure pads 8 to scale 2 for substantially the same reason as discussed above in relation to the first embodiment.

Applying a force on trigger 3 towards side 14 counteracts such spring-activated force, thereby moving or rotating the pressure pads 8 outwardly relative to T-slot 9 and releasing head 1 from fixed engagement with scale 2. The angle necessary to rotate pressure palls 8 so as to withdraw same from T-slot 9 and release pressure upon scale 2 determines minimal distance X. Because of the special relationship between trigger 3, spring 4, pressure pads 8, and pivot point P2, enough force to fix scale 2 is applied through a compounding of forces through ever decreasing distances to gain substantial advantage over the distance as a whole, such that the force induced by spring 4 maintains scale 2 fast, while the force required to release the same is within the limits of the human hand.

In operation, scale 2 is inserted in T-slot 9 of head 1. By gripping head 1 at side 14 and applying pressure to trigger 3, head 1 is slidable along scale 2. Releasing such pressure locks head 1 in the desired position along scale 2. In order to obtain an edge at any desired angle relative to scale 2, scale 20 is inserted in slot 30 of protractor head 20. By rotating lever 23 in one direction, protractor head 20 is slidable along scale 2. Rotating lever 23 in the other direction locks protractor head 20 into position along scale 2.

Although there have been described what are at present considered to be the preferred embodiments of the present invention, it will be understood that the invention can be embodied in other specific forms without departing from the spirit or essential characteristics thereof. The described embodiments are, therefore, to be considered in all aspects as illustrative, and not restrictive. The scope of the invention is indicated by the appended claims rather than the foregoing description.

I claim:

1. A tool square device, comprising:

a scale having a flared peripheral edge;

a base having a slot defined through one side thereof, said slot being shaped to slidingly receive said flared peripheral edge of said scale therein; and means, connected to said base, for locking said base into position along said scale;

said locking means comprising a substantially U-shaped trigger member pivotally connected to said base, said trigger member having a pressure pad fixed at one end thereof which is selectively movable within said slot for engagement with said flared peripheral edge of said scale as said trigger member is pivoted relative to said base, and having a grippable portion at another end thereof for being selectively gripped by a user's hand to effect pivoting movements of said trigger member relative to said base.

2. A tool square device according to claim 1, wherein said trigger member is pivotally connected to said base near said one end thereof such that a pivot connection between said trigger member and said base is disposed a first, smaller distance from said pressure pad and is disposed a second, larger distance from said gripping portion thereof.

3. A tool square device as defined in claim 2, including spring means connected between said trigger member and said base for normally urging said pressure pad into secure engagement with said flared peripheral edge of said scale, said spring means being connected to said trigger member at said gripping portion thereof.

4. A tool square device as defined in claim 1, including spring means connected between said trigger member and said base for normally urging said pressure pad into secure engagement with said flared peripheral edge of said scale, said spring means being connected to said trigger member at said gripping portion thereof.

5. A tool square device according to claim 1, wherein said locking means securely clamps said flared peripheral edge of said scale between said pressure pad and a surface of said base defining said slot, said pressure pad having a flat engagement surface which engages said flared peripheral edge substantially across a full width of the edge.

6. A tool square device according to claim 1, wherein said pressure pad securely engages said flared peripheral edge of said scale as said pressure pad is moved within said slot in a direction away from said base.

7. A tool square device according to claim 1, wherein said pivot pad securely engages said flared peripheral edge of said scale as said pressure pad is moved within said slot in a direction toward said base.

8. A tool square device as defined in claim 1, wherein said scale is I-shaped in cross section so that said scale has two flared peripheral edges, and said slot of said base is T-shaped in cross section such that it can slidingly receive either of said two flared peripheral edges of said scale.

9. A tool square device according to claim 8, wherein said trigger member includes a pair of pressure pads fixed at said one end thereof which are simultaneously movable within said slot of said base for securely engaging respective surfaces of one of said flared peripheral edges of said scale.

10. A tool square device according to claim 1, wherein said trigger member includes a pair of pressure pads fixed at said one end thereof which are simultaneously movable within said slot of said base for securely engaging respective surfaces of said flared peripheral edge of said scale.

11. A tool square device according to claim 1, wherein said gripping portion of said trigger member is shaped to be simultaneously gripped together with another side of said base by a full hand of a user.

12. A tool square device as defined in claim 1, wherein said trigger member is an integral unitary member of fixed dimensions, and said locking means consists of said unitary trigger member, a pivot connection between said trigger member and said base, and a spring connected between said trigger member and said base.

13. A measurement and cutting guide device, comprising:

an elongated scale having an enlarged edge portion;

head means adjustably, slidably connectable to said scale for establishing geometrical orientations therebetween, said head means including a slot defined in one surface thereof and shaped to slidingly receive said enlarged edge portion of said scale;

means for selectively securing said head means to said scale in desired orientations, said securing means including a spring-biased trigger means disposed integrally with said head means for selectively establishing secure engagement between said scale and said head means;

said trigger means including a pressure pad and a spring which normally urges said pressure pad into engagement with said enlarged edge portion so as to force said enlarged edge portion into secure engagement with a surface of said slot under a relatively large pressure;

said trigger means further including a trigger portion shaped to be gripped together with a handle of said head means by a full hand of a user, said trigger portion and said pressure pad being integrally formed together as a substantially U-shaped unitary member with said trigger portion and said pressure pad disposed near opposite ends thereof;

said unitary member being pivotally connected to said head means at a pivot point disposed closely adjacent to said pressure pad; and said spring having one end connected to said head means and an opposite end connected to said unitary member at said trigger portion.

14. A device according to claim 13, wherein:

said head means includes first and second heads, each adjustably, slidably connectable to said scale;

said scale includes a pair of enlarged edge portions, and each of said first and second heads has a slot formed in a surface thereof which is shaped to slidably receive either of said enlarged edges of said scale;

said trigger means is disposed integrally with said first head, and said securing means further include cam means disposed integrally with said second head for securing said second head to either of said enlarged edge portions of said scale; and said cam means includes a cam member selectively movable into said slot on said second head for securely engaging said scale.

* * * * *